United States Patent [19]

Autry et al.

[11] Patent Number: 4,662,088

[45] Date of Patent: May 5, 1987

[54] ACHILLES TENDON PROTECTION AND SUPPORT PAD

[75] Inventors: James C. Autry, Dallas, Tex.; Yung-Ho Lin, Taichung, China

[73] Assignee: Autry Industries, Inc., Dallas, Tex.

[21] Appl. No.: 728,290

[22] Filed: Apr. 29, 1985

[51] Int. Cl.[4] ..... A43B 21/00

[52] U.S. Cl. ..... 36/105; 36/68; 36/71; 36/121

[58] Field of Search ..... 36/105, 68, 121, 122, 36/89, 114, 117, 71

[56] References Cited

U.S. PATENT DOCUMENTS

| | | | |
|---|---|---|---|
| 2,444,428 | 7/1948 | Carrier | 36/89 |
| 2,789,374 | 4/1957 | Planert | 36/71 |
| 2,884,646 | 5/1959 | Alber | 36/71 |
| 3,374,561 | 3/1968 | Werner et al. | 36/121 |
| 3,545,107 | 12/1970 | Cinquegrana | 36/105 |
| 4,451,996 | 6/1984 | Norton et al. | 36/71 |
| 4,542,598 | 9/1985 | Misevich et al. | 36/114 |
| 4,547,982 | 10/1985 | Gamm | 36/114 |
| 4,559,722 | 12/1985 | Norton | 36/105 |

FOREIGN PATENT DOCUMENTS

| | | | |
|---|---|---|---|
| 0149573 | 7/1985 | European Pat. Off. | 36/114 |
| 838587 | 12/1938 | France | 36/117 |
| 1321975 | 2/1963 | France | 36/121 |
| 11785 | of 1886 | United Kingdom | 36/71 |

*Primary Examiner*—Werner H. Schroeder
*Assistant Examiner*—Mary A. Ellis
*Attorney, Agent, or Firm*—Jerry W. Mills; Jefferson Perkins

[57] ABSTRACT

A pad (30) for the protection and support of the Achilles tendon of the foot is provided for an over-the-ankle shoe (10). The pad (30) is formed of resiliently yieldable material and is disposed between the exterior upper (26) of the shoe and an interior linear (28). The pad (30) extends vertically from the top (38) of the shoe downward sufficiently to cover the most exteriorly prominent section of the Achilles tendon, and extends horizontally at least far enough to protect the Achilles tendon from strain or injury, while allowing for flexure of same.

8 Claims, 2 Drawing Figures

ACHILLES TENDON PROTECTION AND SUPPORT PAD

TECHNICAL FIELD OF THE INVENTION

This invention relates in general to above-the-ankle or "high top" shoes and more particularly relates to provisions for protecting and supporting the Achilles tendon and ankle in such shoes.

BACKGROUND OF THE INVENTION

In active-wear shoes which provide support for the ankle, often termed "high top" shoes, a problem has arisen wherein the shoe upper extending above the ankle binds and rubs against the Achilles tendon while the wearer is running, walking or otherwise flexing the foot at the ankle. This problem has heretofore been alleviated by the provision of a notch at the top rear of the shoe upper. This solution is less than optimal, however, as no protection or support is provided for the Achilles tendon. Thus, a design tradeoff has existed where either the shoe can be constructed for a maximum ankle support with no provision for flexing of the Achilles tendon, or a notch can be provided which exposes the Achilles tendon to strain and possible injury.

A need therefore exists to provide an over-the-ankle or high top shoe which both protects and supports the Achilles tendon while being yieldable enough to provide for easy flexing of this tendon.

SUMMARY OF THE INVENTION

The present invention disclosed and claimed herein provides, in a shoe with an upper extending above the ankle, a pad for the protection and support of the Achilles tendon. The pad is formed of resiliently yieldable material and is disposed between the exterior upper and interior liner of the shoe, extends vertically from a horizontal line approximately intersecting the top of the calcaneal bone to a point above the ankle, thus covering the most exteriorly prominent portion of the Achilles tendon, and extends horizontally sufficiently to protect the Achilles tendon in the region of the pad's vertical extension.

Preferably, the pad comprises two pad members. The first pad member, in addition to covering the Achilles tendon area, also extends horizontally around to cover both sides of the ankle. The second pad member, which is made of a material more resilient and less yieldable than the first pad member, covers the Achilles tendon area only. Additional padding and support can be obtained by fabricating the interior liner from a material such as high-performance polyurethane, and also fabricating a portion of the exterior upper covering the second pad member from high-performance polyurethane.

BRIEF DESCRIPTION OF THE DRAWINGS

For a more complete understanding of the present invention and the advantages thereof, reference is now made to the following description, taken in conjunction with the accompanying Drawings, in which.

DETAILED DESCRIPTION OF THE INVENTION

Figure 1:
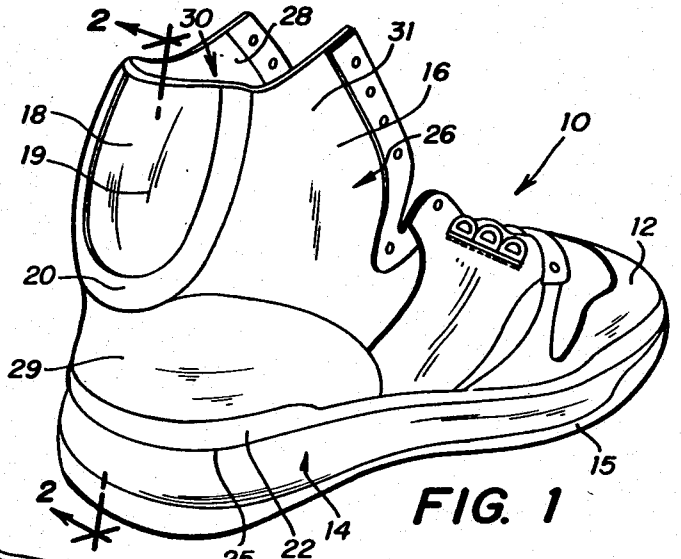
FIG. 1 is a perspective view of an over-the-ankle shoe employing the pad of the invention.

Referring to FIG. 1, an over-the-ankle shoe 10, in this case a "high top" basketball shoe, has an upper 12, preferably constructed mostly of leather, and a shell 14 including a sole 15 which is preferably molded of rubber. Upper 12 has an over-the-ankle region 16, including a U-shaped or "deep dip" portion 18 corresponding to the exteriorly prominent portion of the wearer's Achilles tendon. The exterior 19 of U-shaped portion 18 is preferably constructed of a flexible, somewhat yieldable, highly resilient material, such as fabric-backed polyurethane, to allow for the flexure of the Achilles tendon. U-shaped portion 18 is joined by leather strips 20 as by stitching and gluing the remainder of upper 12. In a preferred embodiment, U-shaped exterior 19 may be coated with a light-reflective material so that the wearer is more visible at night.

Figure 2:
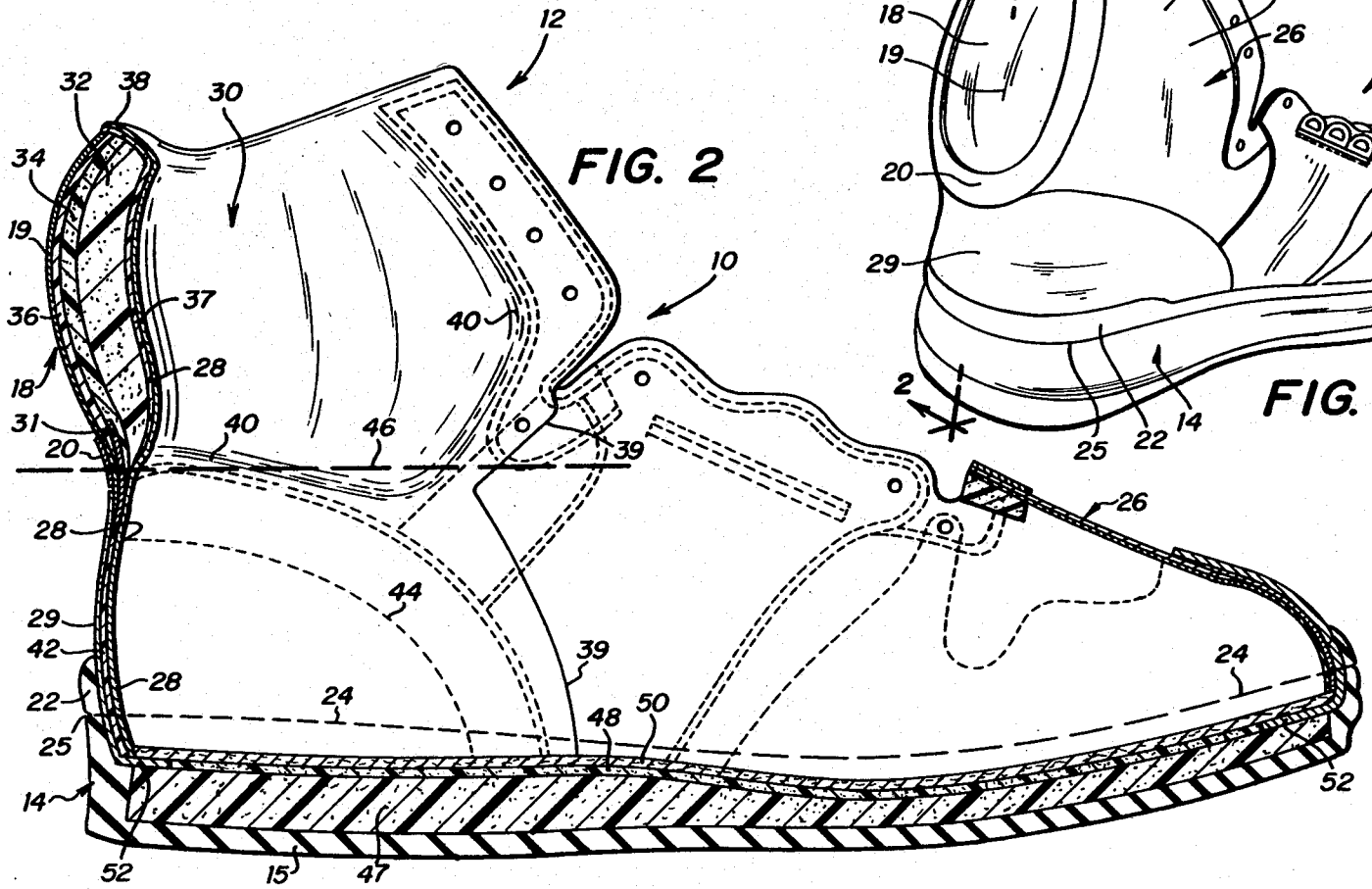
FIG. 2 is an elevational section taken substantially along line 2—2 of FIG. 1.

Referring to FIG. 2, a sectional view of shoe 10 illustrates shell 14 having a lip member 22 by which upper 12 is joined, preferably by a circumferential stitching 24 along stitch line 25 (FIG. 1) and glue. Upper 12 has a leather exterior 26 and a rear interior liner 28 which is preferably constructed of a slightly yieldable, flexible, resilient material such as fabric-backed casting polyurethane. U-shaped exterior 19 is attached as by stitching and gluing to leather strip 20, leather counter exterior 29 and over-the-ankle leather upper component 31. Leather upper component 31 is cut out in a U-shape to receive U-shaped portion 18.

Situated above and inward from strip 20 and component 31, and exterior to rear interior liner 28, is an ankle and Achilles tendon pad 30 that includes a first pad member 32, a second pad member 34, a third pad member 6 and a fourth pad member 37.

First pad member 32, which is constructed of a spongy, relatively yieldable material such as standard grade sponge foam, extends over the Achilles tendon and also covers both the medial and lateral malleoli approximately to margin 40. First pad member 32 is designed to support the malleoli and Achilles tendon while at the same time shielding them from external impact. Second pad member 34 overlays first pad member 32 and is constructed of a somewhat more resilient and less yieldable material such as high-density sponge foam. Second pad member 34 extends over a region corresponding to U-shaped portion 18, giving the Achilles tendon additional protection and support as it flexes. Third pad member 36, which is preferably constructed of high-performance polyurethane foam, is disposed between second pad member 34 and U-shaped exterior 19. Third pad member 36 extends across U-shaped portion 18 and is glued to upper component 31. First pad member 32, second pad member 34, third pad member 36 and U-shaped exterior 19 are attached to each other as by gluing, preferably using a polyethylene glue.

Fourth pad member 37 generally extends over the entire rear area of shoe 10, and is glued to and is exterior to rear interior liner 28. Fourth pad member 37 and interior liner 28 are coextensive, extending forwardly to margin 39, except where fourth pad member 37 is displaced by a counter reinforcing element 42. Counter reinforcing element 42, which can be fabricated from a hard, tough plastic such as polystyrene, extends forwardly to the extent shown by dotted line 44. Pad members 32, 34 and 36 extend from the top 38 of shoe 10 downwardly to a horizontal line 46 roughly tangential to the top of the calcaneal bone, thus covering the most exterior prominent portion of the Achilles tendon. As shown, this horizontal line 46 interacts with strip 20. The present invention thus provides cushioning support to the wearer's Achilles tendon without the requirement of a cut down heel top which exposes the tendon.

Glued into shell 14 is a midsole 47, preferably made of lhtlon, a type of ethylene vinyl acetate having a higher than usual concentration of vinyl and a lower than usual concentration of ethylene. Lhtlon, fabric-backed casting polyurethane, high-performance polyurethane foam and high-performance sponge foam are all available from Ching-Shun Enterprises of Taiwan. A filler 48, which can be made of fabric-backed rubber foam, is situated on top of midsole 47. A texon 50, made out of a leatherized paper composed of 70% leather fibers and 30% paper, is glued to the top of filler 48 and a circumferential tab member 52 of leather exterior 26.

While the illustrated embodiment concerns a "high top" basketball shoe, it should be understood that the invention can be applied to any over-the-ankle, active wear shoe, such as a hiking boot or a construction boot. In any event, it should be understood that various changes, substitutions and alterations can be made to the illustrated embodiment without departing from the spirit and scope of the invention, which is defined by the appended claims.

What is claimed is:

1. A shoe with an upper extending above the ankle comprising:

a U-shaped pad formed in the upper region of said upper and including a U-shaped exterior layer more flexible than leather, said U-shaped pad delimited by and joined to a leather exterior upper portion that extends horizontally to cover the lateral and medial malleoli;

an inner pad for the protection and support of both the Achilles tendon and the lateral and medial malleoli, being disposed interiorly of said U-shaped pad and said leather upper portion;

an interior layer disposed interiorly of said inner pad and comprising a flexible, resilient, shock-absorbing material, said U-shaped pad extending from the top of the shoe downward sufficiently to cover the prominent section of the Achilles tendon, said portion being constructed of a flexible, resilient, shock-absorbing material;

said inner pad comprising a first pad member constructed of a spongy, resilient, relatively yieldable material, and a second pad member adjacent to and overlaying said first pad member, said second pad member being constructed of a material which is more resilient and less yieldable than said first pad member;

said first and second pad members extending vertically from a point above the ankle downward to cover the most exteriorly prominent section of the Achilles tendon, said first and second pad members extending horizontally around the rear of said shoe to cover the Achilles tendon and lateral and medial malleoli.

2. The shoe of claim 1 wherein said U-shaped exterior layer comprises fabric-backed casting polyurethane.

3. The shoe of claim 1, wherein said interior layer comprises fabric-backed casting polyurethane.

4. The shoe of claim 1, wherein said first pad is fabricated from standard grade sponge foam.

5. The shoe of claim 1, wherein said second pad member is fabricated from high-density sponge foam.

6. The shoe of claim 1, wherein said upper is formed from leather.

7. The shoe of claim 1, wherein said U-shaped pad comprises:

a third pad member and a fourth pad member;

said third pad member being disposed exteriorly of said second pad member and interiorly of said fourth pad member, said third pad member extending vertically from the top of the shoe downward to cover the most exteriorly prominent section of Achilles tendon and extending horizontally around the rear of said shoe to cover the Achilles tendon; and said fourth pad member being disposed exteriorly of said third pad member and interiorly of said U-shaped exterior layer, said fourth pad member extending vertically from a point above the ankle downward to cover the most exteriorly prominent section of the Achilles tendon, said fourth pad member extending horizontally around the rear of said shoe to cover the Achilles tendon.

8. The shoe of claim 7, wherein said second and third pad members are fabricated from high-performance polyurethane foam.

* * * * *